US005785130A

United States Patent [19]

Wesson et al.

[11] Patent Number: 5,785,130

[45] Date of Patent: Jul. 28, 1998

[54] HIGH DENSITY PERFORATING GUN SYSTEM

[75] Inventors: David S. Wesson, Waxahachie; Dan W. Pratt, Fort Worth, both of Tex.

[73] Assignee: Owen Oil Tools, Inc., Fort Worth, Tex.

[21] Appl. No.: 724,691

[22] Filed: Oct. 1, 1996

Related U.S. Application Data

[60] Provisional application No. 60/004,793 Oct. 2, 1995.

[51] Int. Cl.[6] ..... E21B 43/117

[52] U.S. Cl. ..... 175/4.6; 102/310; 166/55.1

[58] Field of Search ..... 175/4.6; 166/55.1, 166/297; 102/310

[56] References Cited

U.S. PATENT DOCUMENTS

| | | | |
|---|---|---|---|
| 4,726,431 | 2/1988 | Oestreich et al. | 175/4.6 |
| 4,844,170 | 7/1989 | Gill | 166/297 |
| 4,960,171 | 10/1990 | Parrott et al. | 175/4.6 |
| 5,007,486 | 4/1991 | Ricles | 175/4.6 |
| 5,392,857 | 2/1995 | Behrmann | 166/297 |
| 5,619,008 | 4/1997 | Chawla et al. | 102/310 |
| 5,648,635 | 7/1997 | Lussier et al. | 175/4.6 X |

*Primary Examiner*—Hoang C. Dang
*Attorney, Agent, or Firm*—Charles D. Gunter, Jr.

[57] ABSTRACT

A high density perforating gun having a carrier housing tube and an interior charge holder tube through which are mounted zinc alloy shaped charges in a phased relationship between about 135 and 145 degrees. The 135 to 145 degree phased relationship provides for an 18 shot per foot perforating gun system. The shaped charges of selected length are inserted into the carrier housing tube and held in place by fastener rings fitted to fastener ring slots. The nose ends of the shaped charges are fitted with ears to receive a detonating cord. This positions the primer cord in tension and generally coaxially with the carrier housing tube to prevent charge interference and assure sequential detonation.

8 Claims, 3 Drawing Sheets

HIGH DENSITY PERFORATING GUN SYSTEM

CROSS REFERENCE TO RELATED APPLICATION

This application claims the benefit of U.S. Provisional Application No. 60/004,793, filed Oct. 2, 1995, entitled, "High Density Perforating Gun System," further identified by Attorney Docket No. 0750F-016.

BACKGROUND OF THE INVENTION

1. Field of the Invention

The present invention relates to through tubing perforation guns used to support explosive charges in a borehole to form perforations through which water, petroleum or minerals are produced.

2. Background Information

This invention is an improvement to phased, through tubing, perforating systems in that it allows for a high shot density of directional shaped charges in a phased orientation between about 135 and 145 degrees.

Standard sizes for perforating systems for completing wells in 7 inch casing range from 4⁷⁄₁₆ths inches outside diameter to 5¼th inches outside diameter. The typical wall thickness for the carrier tube is from ⅜ths of an inch to ⁷⁄₁₆ths of an inch. The most common perforating gun systems for gravel pack completions in 7 inch casing have 4½ inch outside diameters with 12 shots per foot. The systems are typically phased with 135 degrees rotation between shots and therefore will have eight rows of shots in the casing. The standard size hole that the most common perforating guns make in the casing is about 0.70 of an inch in diameter. There is a need to perforate the casing with a higher shot density than 12 shots per foot. It is desirable to shoot as many holes per foot as possible into the casing, so long as the size of each hole does not drop below 0.70 of an inch in diameter. It is also desirable to be able to shoot a shaped charge made of zinc alloy so that the undesirable debris from the system is reduced. This need should be fullfilled with a perforation gun that achieves a high density of perforations in a manner that does not weaken the performance of the gun or the structural integrity of the gun or the casing.

SUMMARY OF THE INVENTION

The general object of the invention is to provide a gun for well perforating that overcomes the various disadvantages of the prior art devices. The present invention is a 4½ inch diameter, 18 shot per foot gun that produces an actual hole size in the casing of at least 0.70 of an inch in diameter with a zinc alloy charge case or steel charge case. This performance is accomplished by shooting sequentially with a phasing of between about 135 and 145 degrees between shots with a shaped charge liner diameter of 1.690 inches or larger. This 135 to 145 degree phasing provides for 18 rows of shot in the casing. The present invention produces 50 percent more flow area than the conventional 4½ inch, 12 shot per foot system in a 7 inch diameter casing.

The 135 to 145 degree phasing makes the 18 shot per foot shot density possible with the given liner size and carrier tube inside diameter. It minimizes the loss in casing strength since the holes made in the casing by the shaped charges are about 12 inches apart vertically, as opposed to the prior art 135 degree phasing which results in a vertical separation between shots of only about 5.33 inches.

DETAILED DESCRIPTION OF THE INVENTION

Figure 1:
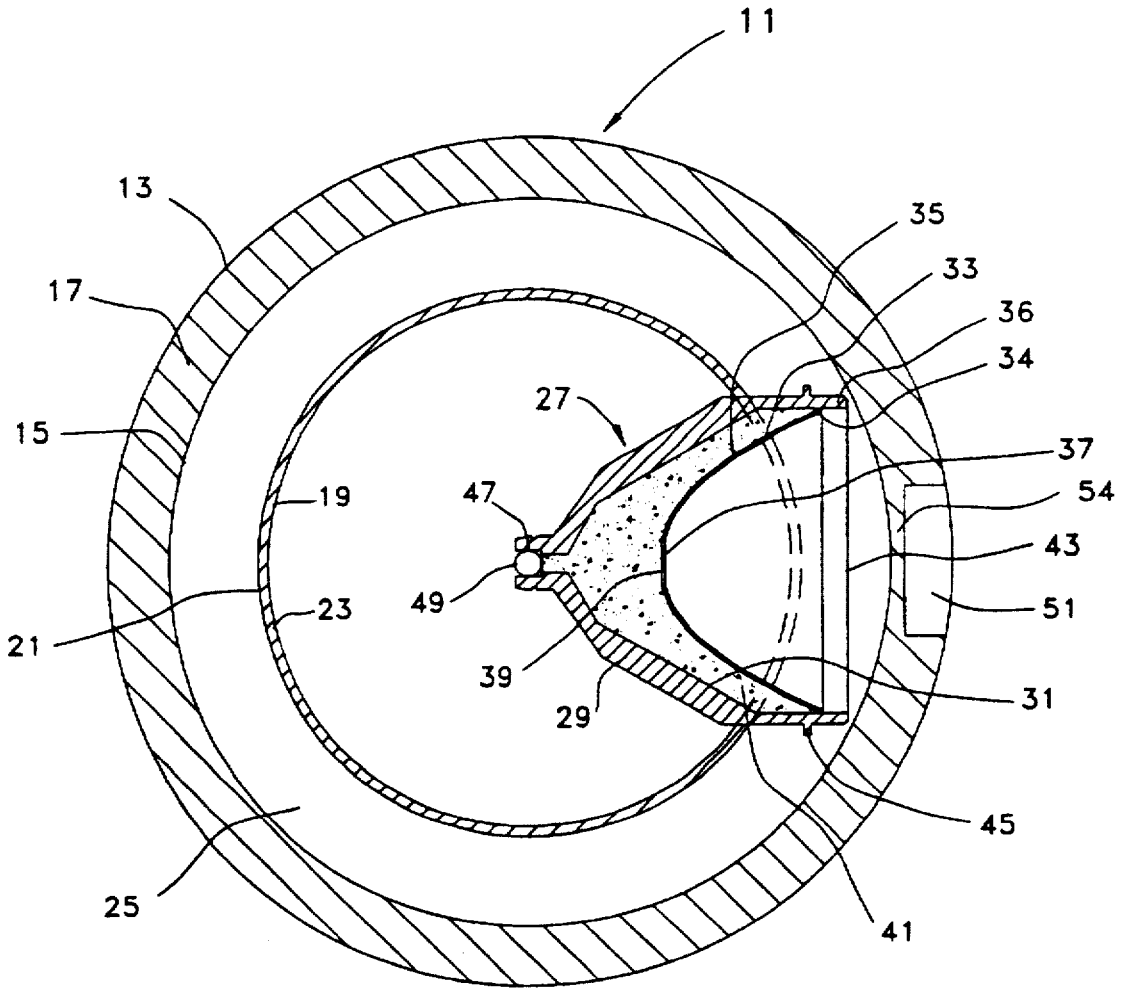
FIG. 1 is a cross-sectional view showing a shaped charge positioned in a perforating gun.

Referring initially to FIG. 1 of the drawings, numeral 11 illustrates a tubular high density perforating gun system of the present invention with a carrier housing tube 17 having an interior annular surface 15 and an exterior annular surface 13. The outside diameter of the carrier housing tube 17 is preferably between 4⁷⁄₁₆ths and 5¼th inches. The charge holder tube 19 has an exterior annular surface 21 and an interior annular surface 23 that forms a concentric cylinder and is generally coaxial with the carrier housing tube 17 and is located within the carrier housing tube 17. The diameter of the annular outside surface 21 of the charge holder tube 19 is such that an annular space 25 is created between the annular outer surface 21 of charge holder tube 19 and the annular inner surface 15 of the carrier housing tube 17.

The numeral 27 designates a shaped charge having a frusto-conical charge case 29 with an interior surface 31. The charge case 29 is preferably manufactured from a zinc alloy with similar composition and properties as ZA-5 (No. 5) described in publications by the American Die Casters Association and commercially available. A frusto-conical charge liner 43 has an explosive material retaining wall 33 with an exterior surface 35. Charge liner 43 is attached at its base 34 to the base 36 of the charge case 29 and extends into the conical space of the charge case 29. The diameter of the base 34 of the charge liner 43 is at least about 1.690 inches. A firing plate 37 with an exterior surface 39 forms the nose of the explosive material retaining wall 33 of the charge liner 43. Shaped explosive 41 is located in the area prescribed by the interior surface 31 of the charge case 29, the exterior surface 35 of the explosive material retaining wall 33, and the exterior surface 39 of the firing plate 37. An annular fastener ring 45 is located near the base 36 of the charge case 29 and extends radially outward.

Located at the nose of the charge case 29 is a plurality of ears 47 which extend outwardly from the charge case 29 in a parallel fashion to receive a primer cord 49. The length from the base 34 of the charge liner 43 to the ears 47 is such that the axis (not shown) of the primer cord 49 is located slightly off center, preferably about 20/1,000ths of an inch, of the charge holder tube 19, thereby allowing a snug fit of the primer cord 49 within the ears 47 when the primer cord 49 is put in tension upon assembly. The primer cord 49 is conducively attached to an electrical means (not shown) to sequentially fire the shaped charges 27. This off center assembly of the primer cord 49 in tension assures an electrically conducive contact between the primer cord 49 and the shaped explosive 41 and alleviates the need for clips or additional means of retaining the primer cord 49 in contact with the shaped explosive 41. This off center assembly of the primer cord 49 also prevents loss of performance of the shaped charges 27 due to charge interference or nonsequential firing.

A carrier housing tube bore 51, with an axis (not shown) which is perpendicular to the axis of the carrier housing tube 17, is located on the carrier housing tube 17 of the perforating gun 11, and has a diameter slightly less than that of the base 34 of the charge liner 43. The carrier housing tube bore 51 extends to a depth about half way through the carrier housing tube 17 from the outside edge 13 of the carrier housing tube 17 leaving a selected unbreached portion 54 in the carrier housing tube 17.

Figure 2:
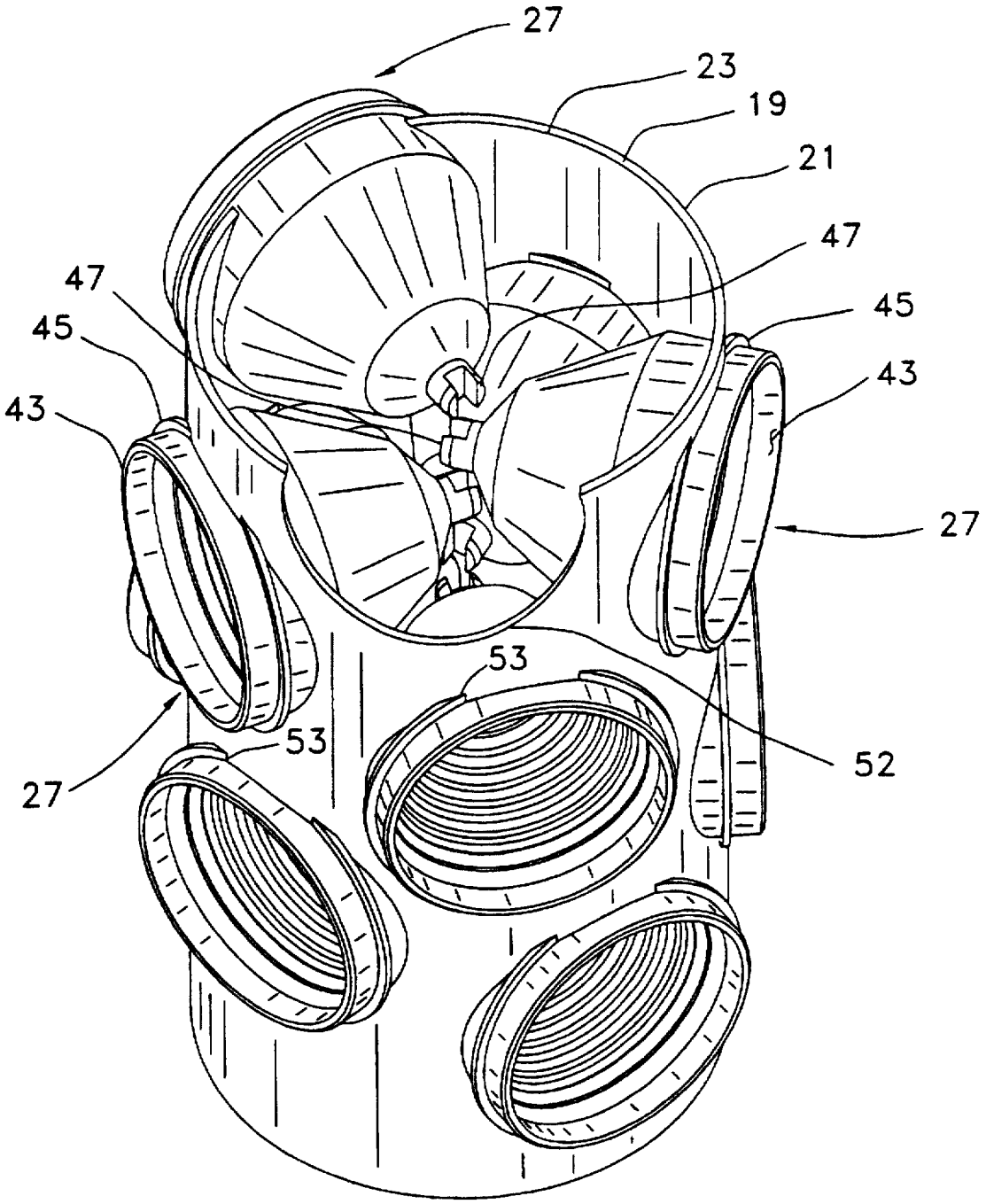
FIG. 2 is a schematic assembly of a plurality of shaped charges mounted in a charge holder tube in a high shot density fashion according to the invention.
Figure 3:
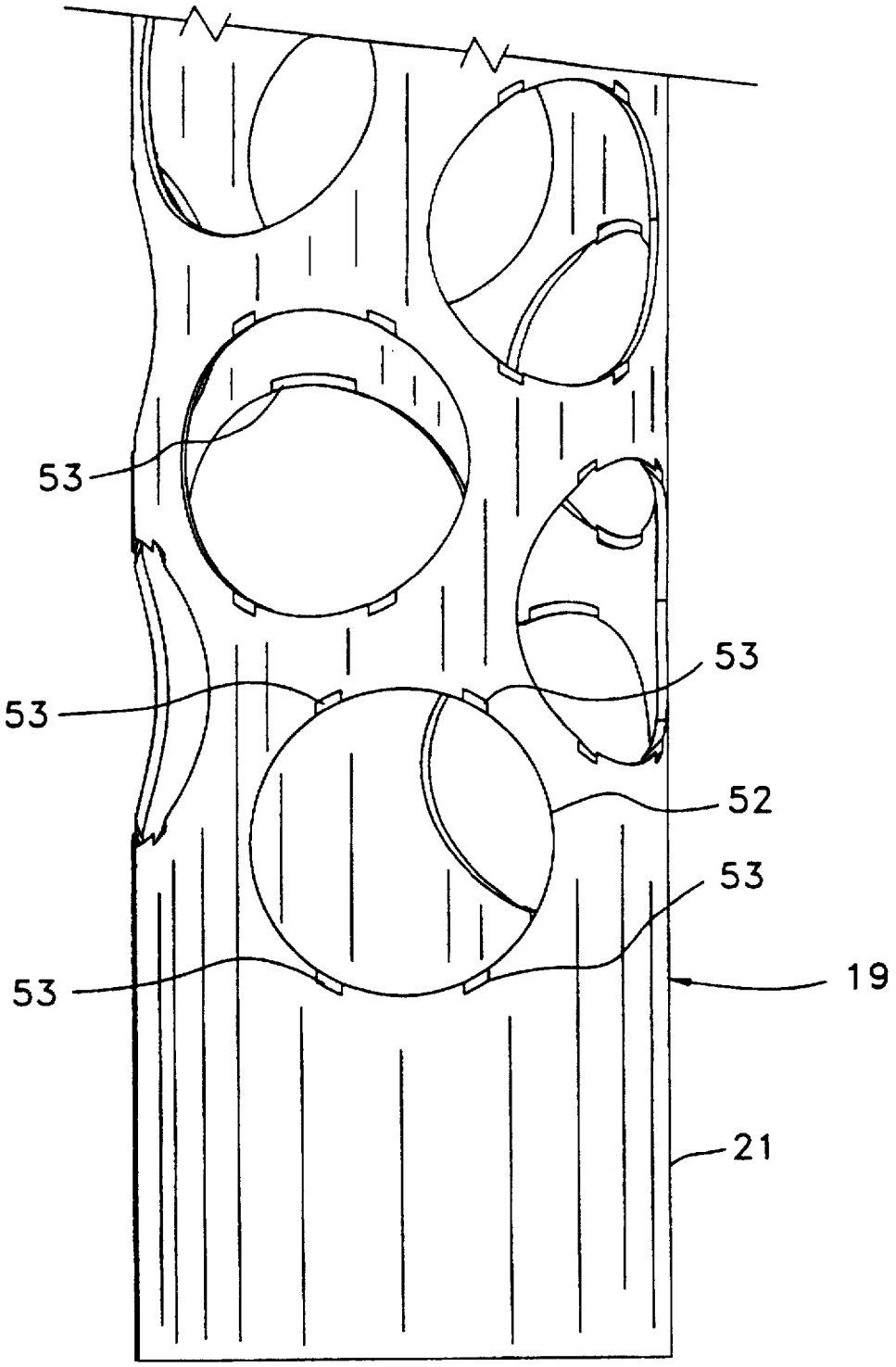
FIG. 3 is a side elevational view of the carrier tube with a plurality of apertures phased between 135 and 145 degrees to receive shaped charges.

Referring now to FIG. 2 and FIG. 3 in the drawings, a plurality of shaped charges 27, in schematic here, are shown assembled in the charge holder tube 19 in phase between about 135 and 145 degrees. In the preferred embodiment, a plurality of apertures 52 are milled with a phasing between about 135 and 145 degrees through a tube, preferably a drawn over mandrel (DOM) tube, by a multiple axes laser milling machine or any other device known in the art for milling apertures in tubes. Fastener ring slots 53 are cut by a laser milling machine, or any other device known in the art, into the the top and bottom edges of the apertures 52 in the charge holder tube 19 to receive the fastener ring 45 of the shaped charges 27.

The shaped charges 27 are inserted into the charge holder tube 19 and held in place by the fastener rings 45 with a pressure fit into the fastener ring slots 53. The primer cord 49 is fed through the ears 47 of the charge case 29. The charge holder tube 19 with the attached shaped charges 27, located in phase about the charge holder tube 19 between about 135 and 145 degrees, and at a shot density of at least 18 shots per foot, is inserted into the carrier housing tube 17 and attached thereto by connector means (not shown).

The carrier housing tube bores 51 are milled into the carrier housing tube 17 in phase between about 135 and 145 degrees by means commonly known in the art. The carrier housing tube bores 51 are aligned with the charge liners 43 such that the unbreached portions 54 of the carrier housing tube 17 are located in front of the charge liners 43. The thus assembled perforating gun 11 is then attached to an upper end connector (not shown) for mounting on a conveyance sub (not shown) to raise or lower and position the perforating gun 11 at the selected position in the well adjacent to the geological formation to be perforated.

Upon detonation, the unbreached portion 54 of the carrier housing tube 17 is burned through first. Perforations are made through the casing and the diameter of at least selected perforations in the casing is at least 0.70 inches.

In an alternate embodiment, the high density perforating gun 11 has a carrier housing tube 17 with an outside diameter between about 6½ and 7½ inches. The base 34 of the charge liner 43 has a diameter of at least about 2.500 inches. The shaped explosives 41 of this alternate embodiment are configured such that the diameter of at least selected perforations is at least 1.00 inch, and the shot density is at least 18 shots per foot.

It should be apparent from the foregoing that an invention having significant advantages has been provided. The high density perforating gun system 11 is configured to enable the orientation of shaped charges 27 in phase between about 135 and 145 degrees as shown in FIGS. 1–3 in which the carrier housing tube 19 is used to position the shaped charge 27 and others like it to form perforations in the casing and into the geological formation. Moreover, the high density perforating gun system 11 when constructed as indicated above, allows at least 18 shots per foot into the geological formation in a manner that does not weaken the performance of the perforating gun 11 or the structural integrity of the gun assembly or the casing.

While the invention is shown in only one of its forms, it is not just limited but is susceptible to various changes and modifications without departing from the spirit thereof.

We claim:

1. A tubular, high shot density well perforating gun for producing a perforation through a well casing comprising:

a carrier housing tube having an outside diameter within a range of about 4⁷⁄₁₆ths to 5¼th inches;

a charge holder tube positioned generally coaxially within the carrier housing tube;

a plurality of shaped charge cases, containing shaped explosives, carried spirally by the charge holder tube within a range of about 135 to 145 degree phasing and a shot density of at least 18 shots per foot;

a primer cord positioned inside the charge holder tube to detonate the shaped explosives;

the shaped charge cases having a plurality of ears to receive the primer cord;

the shaped charge cases having a liner with a diameter of at least about 1.690 inches;

the shaped charge cases having a length such that the primer cord is substantially coaxial with the charge holder tube to prevent loss of performance of the shaped explosives due to charge interference; and wherein each shaped explosive is configured such that the diameter of perforations produced by the shaped explosives is at least 0.70 of an inch.

2. The invention defined by claim 1 wherein the charge cases are constructed of a zinc alloy.

3. The invention defined by claim 1 wherein after assembly between the ears of the charge cases, the primer cord is held in tension within the charge holder tube, thereby assuring contact between the primer cord and the shaped explosive.

4. The invention defined by claim 1 wherein the 135 to 145 degree phasing range is such that the vertical distance between the perforations in the casing produced by the shaped explosives contained in shaped charge cases is about 12 inches.

5. A tubular, high shot density well perforating gun for producing a perforation through a well casing comprising:

a carrier housing tube having an outside diameter within a range of about 6½ to 7½ inches;

a charge holder tube positioned generally coaxially within the carrier housing tube;

a plurality of shaped charge cases, containing shaped explosives, carried spirally by the charge holder tube within a range of about 135 to 145 degree phasing and a shot density of at least 18 shots per foot;

a primer cord positioned inside the charge holder tube to detonate the shaped explosives;

the shaped charge cases having a plurality of ears to receive the primer cord;

the shaped charge cases having a liner with a diameter of at least about 2.500 inches;

the shaped charge cases having a length such that the primer cord is substantially coaxial with the charge holder tube to prevent loss of performance of the shaped explosives due to charge interference; and wherein each shaped explosive is configured such that the diameter of perforations produced by the shaped explosives is at least 1.00 inch.

6. The invention defined by claim 5 wherein the charge cases are constructed of a zinc alloy.

7. The invention defined by claim 5 wherein after assembly between the ears of the charge cases, the primer cord is held in tension within the charge holder tube, thereby assuring contact between the primer cord and the shaped explosive.

8. The invention defined by claim 5 wherein the 135 to 145 degree phasing range is such that the vertical distance between the perforations in the casing produced by the shaped explosives contained in shaped charge cases is about 12 inches.

* * * * *